US006338367B1

(12) United States Patent
Khokar

(10) Patent No.: US 6,338,367 B1
(45) Date of Patent: Jan. 15, 2002

(54) WOVEN 3D FABRIC MATERIAL

(75) Inventor: Nandan Khokar, Gothenburg (SE)

(73) Assignee: Biteam AB, Bromma (SE)

( * ) Notice: Subject to any disclaimer, the term of this patent is extended or adjusted under 35 U.S.C. 154(b) by 0 days.

(21) Appl. No.: 09/380,489

(22) PCT Filed: Mar. 3, 1997

(86) PCT No.: PCT/SE97/00356

§ 371 Date: Sep. 3, 1999

§ 102(e) Date: Sep. 3, 1999

(87) PCT Pub. No.: WO98/39508

PCT Pub. Date: Sep. 11, 1998

(51) Int. Cl.[7] ..... D03D 41/00
(52) U.S. Cl. ..... 139/DIG. 1; 139/11
(58) Field of Search ..... 139/11, DIG. 1

(56) References Cited

U.S. PATENT DOCUMENTS

| | | | |
|---|---|---|---|
| 4,615,256 A | 10/1986 | Fukuta et al. | |
| 5,242,768 A | 9/1993 | Nagatsuka et al | |
| 5,465,760 A | 11/1995 | Mohamed et al. | 139/11 |
| 5,665,451 A | 9/1997 | Dorn et al. | 428/116 |

FOREIGN PATENT DOCUMENTS

| | | |
|---|---|---|
| DE | 4342575 A1 | 4/1995 |
| EP | 0236500 A1 | 9/1987 |
| EP | 0426878 A1 | 5/1991 |
| EP | 0538481 A1 | 4/1993 |
| WO | 93 05950 | 4/1993 |

*Primary Examiner*—John J. Calvert
*Assistant Examiner*—Robert H. Muromoto
(74) *Attorney, Agent, or Firm*—Birch, Stewart, Kolasch & Birch, LLP

(57) ABSTRACT

A woven 3D fabric material comprises multilayer axial warp yarns and two orthogonal sets of weft which interlace with the rows and the columns of the warp respectively to provide integrity to the fabric which may additionally incorporate between the rows and the columns of the interlacing warp sets of non-interlacing multi-directionally orientated yarns in the fabric-length, -width, -thickness, and two diagonal directions respectively to improve the fabric's mechanical properties. The interlacing of the multilayer warp and the two orthogonal sets of weft is enabled by a dual-directional shedding means which forms sheds in the row-wise and the column wise directions of the multilayer warp. The produced woven 3D fabric material which may be cut into any desired shape without the risk of splitting up, may be wholly or in parts in technical applications.

15 Claims, 9 Drawing Sheets

WOVEN 3D FABRIC MATERIAL

This application is the national phase under 35 U.S.C. §371 of PCT International Application No. PCT/SE97/00356 which has an International filing date of Mar. 3, 1997, which designated the United States of America.

TECHNICAL FIELD

This invention relates to a woven 3D fabric and its method of production. In particular, the woven 3D fabric comprises multilayer warp yarns and two orthogonal sets of weft which interlace with the rows and the columns of the warp to provide a network-like structure to the fabric which may additionally incorporate between the rows and the columns of the interlacing warp multi-directionally orientated non-interlacing yarns to improve the fabric's mechanical performance. Such a fabric is considered useful in technical applications like the manufacture of composite materials, filters, insulating materials, separator-cum-holder for certain materials, electrical/electronic items, protection material, etc.

BACKGROUND

In the conventional weaving process the foremost operation of shedding is limited in its design to form a shed in only the fabric-width direction. The employed warp, which is either in a single or a multiple layer, is separated into two parts in a 'crossed' manner, in the direction of the fabric-thickness through the employment of the heald wires which are reciprocated through their frames by means such as cams or dobby or jacquard to form a shed in the fabric-width direction. Each of these heald wires have only one eye located midway and all the employed heald assemblies are reciprocated in only the fabric-thickness direction to form a shed in the fabric-width direction. A weft inserted into this formed shed enables interconnection between the separated two layers of the warp. The so interconnected warp and weft results in an interlaced structure which is called the woven fabric. A fabric when produced using a single layer warp results in a sheet-like woven material and is referred to as a woven 2D fabric as its constituent yarns are supposed to be disposed in one plane. Similarly, when a fabric is produced using a multiple layer warp, the obtained fabric which is characteristically different in construction from the woven 2D fabric, is referred to as a woven 3D fabric because its constituting yarns are supposed to be disposed in a three mutually perpendicular plane relationship. However, in the production of both these types of woven 2D and 3D fabrics the conventional weaving process, due to its inherent working design, can only bringing about interlacement of two orthogonal sets of yarn: the warp and the weft. It cannot bring about interlacement of three orthogonal sets of yarns: a multiple layer warp and two orthogonal sets of weft. This is an inherent limitation of the existing weaving process. The present invention provides a dual-directional shedding method to form sheds in the columnwise and the row-wise directions of a multilayer warp to enable interlacement of the multilayer warp and two orthogonal sets of weft.

Certain technical fabric applications require complex or unusual shapes besides other specific characteristics for performance such as a high degree of fabric integration and proper orientation of the constituent yarns. For example, at present it is not possible to obtain a suitable fabric block from which preforms (reinforcement fabric for composite material application) of any desired shape may be cut obtained. This is because the present fabric manufacturing processes of weaving, knitting, braiding and certain non-woven methods which are employed to produce preforms cannot deliver a suitable highly integrated fabric block from which preforms of any desired shape may be cut obtained. With a view to obtain certain regular cross-sectional shaped preforms, suitable fabric manufacturing methods working on the principles of weaving, knitting, braiding and certain nonwoven techniques have been developed. Such an approach of producing preforms having certain cross-sectional shapes is referred to as near-net shaping. However, through these various techniques preforms of only certain cross-sectional profiles can be produced and preforms of any desired shape cannot be manufactured. The obtaining of preforms of any desired shape can be made practically possible only if a highly integrated fabric block can be made available so that the required shape can be cut from it without the risk of its splitting up. Also, fabrics for other applications like filters of unusual shapes can be similarly cut obtained from a suitable fabric block. For analogy, this strategy of obtaining any desired shape of three-dimensional fabric item may be seen as the cutting of different shapes of fabric items from a suitable sheet of 2D fabric, for example, during the manufacture of a garment. Therefore, as can be inferred now, to cut obtain three-dimensional fabric items of any desired shape it is essential to first produce a highly integrated fabric in the form of a block. The present invention provides a novel method to interlace a multilayer warp and two orthogonal sets of weft to produce a thoroughly interlaced woven 3D fabric construction which may additionally incorporate non-interlaced, multi-directionally orientated yarns to impart mechanical performance to the fabric, as shown in FIG. 1, to be useful in technical applications.

OBJECTIVES OF THE PRESENT INVENTION

An objective of this invention is to make available a block of network-like, highly integrated 3D fabric which may additionally incorporate non-interlaced multi-directionally orientated yarns to impart proper mechanical strength to the fabric so that suitable fabric items of any desired shape for use in technical applications can be cut without the risk of its splitting up. Because certain fabric items may be obtained easily this way, such an approach can be advantageous in the manufacture of preforms, i.e. reinforcement fabric for composites application, filters etc. of any desired shape.

Another objective of this invention is to provide a dual-directional shedding method to enable interlacement of three orthogonal sets of yarn: a set of multilayer warp and two orthogonal sets of weft. Such an interlacement of the three orthogonal sets of yarn is necessary to provide a high degree of integrity to the fabric to render the fabric resistant to splitting up in the fabric-width as well as in the fabric-thickness directions. This way the objective of producing a network-like interlaced 3D fabric, which may additionally incorporate non-interlacing, multi-directionally orientated yarns, is made possible.

The integrity of the fabric is achieved through the formation of multiple row-wise and columnwise sheds in the employed multiple layer warp. Two orthogonal sets of weft when inserted in the formed row-wise and columnwise sheds produce a network-like, interlaced 3D fabric. Because the foremost operation of the weaving process happens to be the shedding operation, all other subsequent complementing operations of the weaving process, for example picking, beating-up etc., will follow suit accordingly. As this invention concerns the method of enabling interlacement of two orthogonal sets of weft and a multilayer warp by way of forming sheds in the columnwise and row-wise directions of the multilayer warp and to additionally incorporate multi-directionally orientated non-interlacing yarns in different directions of the fabric to produce a highly integrated fabric structure having a high mechanical performance, it will be described in detail. The subsequent complementing weaving operations like picking, beating-up, taking-up, letting off etc. will not be described as these are not the objectives of this invention. With a view to keep the description simple and to the point, the simplest mode of carrying out the dual-directional shedding operation will be exemplified and will pertain to the production of the woven plain weave 3D fabric only. The method of producing numerous other weave patterns through this invention will be apparent to those skilled in the art and therefore it will be only briefly mentioned as these various weave patterns can be produced on similar lines without deviating from the spirit of this invention.

BRIEF DESCRIPTION OF THE DRAWINGS

The invention is described in reference to the following illustrations.

DESCRIPTION OF THE PREFERRED EMBODIMENTS

The method of producing network-like, interlaced 3D fabric using two orthogonal sets of weft and a multilayer warp will now be described in reference to the above stated drawings. The working principle of the dual-directional shedding method will be described first and then the particular way of constructing useful fabrics will be described.

Figure 1:
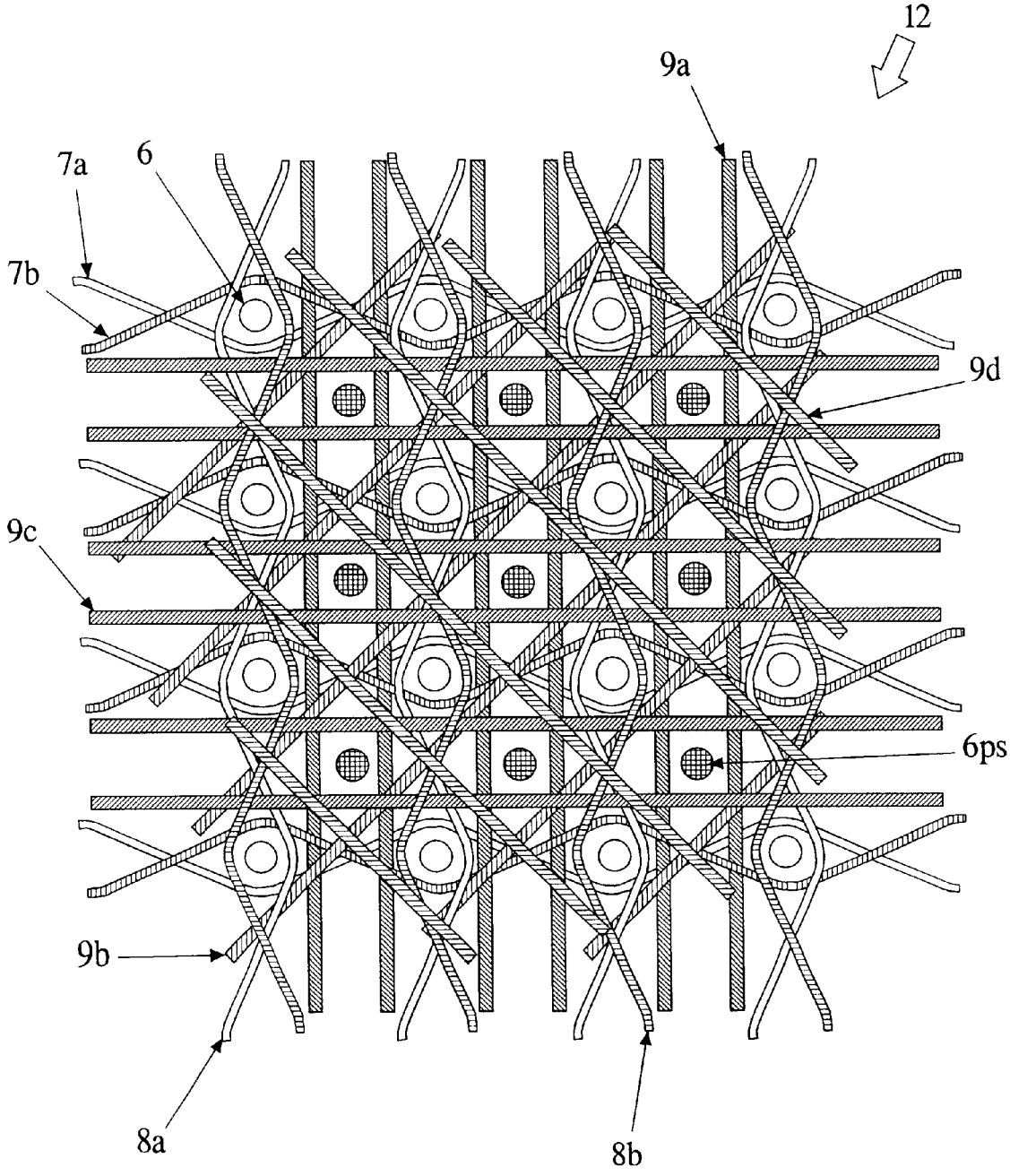
FIG. 1 is an axial view of one embodiment of the woven 3D fabric comprising multilayer warp, two orthogonal sets of weft and multi-directionally orientated non-interlacing yarns.
Figure 2:
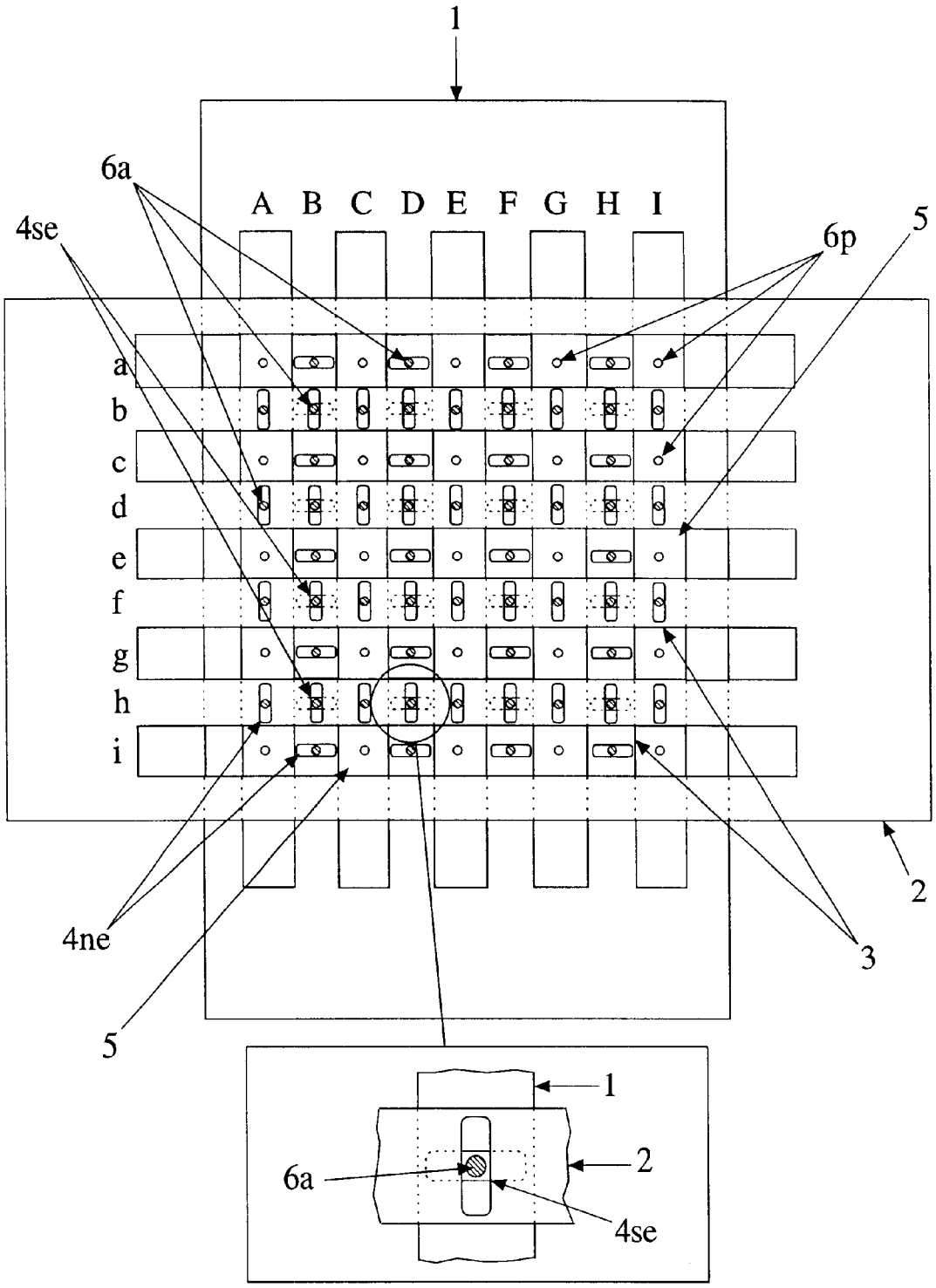
FIG. 2 shows the preferred arrangement of the heald frames for carrying out dual-directional shedding.

Two mutually perpendicular sets of heald frames (1 and 2) are arranged in parallel planes as shown in FIG. 2. The heald frame (1) comprising heald wires (3), henceforth referred to as heald assembly (1), is capable of being reciprocated rectilinearly in the vertical direction, and the heald frame (2) also comprising heald wires (3), henceforth referred to as heald assembly (2), is capable of being reciprocated rectilinearly in the horizontal direction. As shown in FIG. 2, the heald wire (3) has a number of openings or perforations, defined by a major and a minor axis, such that the major axis of it is orientated perpendicular to the length direction of the heald wire (3). These perforations may be referred to as the heald eye (4*ne*). Through each of these eyes (4*ne*), and other openings (5) created by the superimposition of the two sets of heald assemblies (1) and (2), including the superimposed heald-eyes (4*se*), an end of a multilayer warp yarn (6) is drawn through. All these warp ends (6) will thus be disposed in columns 'A' through 'I' and rows 'a' through 'i'. The warp ends (6) of the alternate rows 'a', 'c', 'e' etc. which come under alternate columns designated by A, C, E, G, I are drawn through the open spaces (5) occurring between the two arranged heald assemblies. As shown in FIG. 2, these warp ends (6), which are labelled (6*p*), constitute the stationary or passive warp ends. The warp ends of the alternate rows 'a', 'c', 'e' etc. which come under the alternate columns designated B, D, F, H are drawn through the heald eyes (4*ne*) of the vertically reciprocative heald (1). The warp ends of the alternate rows 'b', 'd', 'f' etc. which come under the alternate columns designated by A, C, E, G, I are drawn through the heald eyes (4*ne*) of the horizontally reciprocative heald (2). The warp ends of the alternate rows 'b', 'd', 'f' etc. which come under the alternate columns designated B, D, F, H are drawn through the superimposed eyes (4*se*) of the two heald assemblies. The heald eyes (4*ne*) of the two mutually perpendicular heald wires (3) and their mutual superimposed arrangement of location (4*se*) due to the mutually perpendicular arrangement of the two healds (1) and (2) are indicated in the inset of FIG. 2. All the warp ends (6) which pass through the heald eyes (4*ne*) and (4*se*), which are labelled (6*a*), constitute the movable or the active warp ends.

Figure 3A:
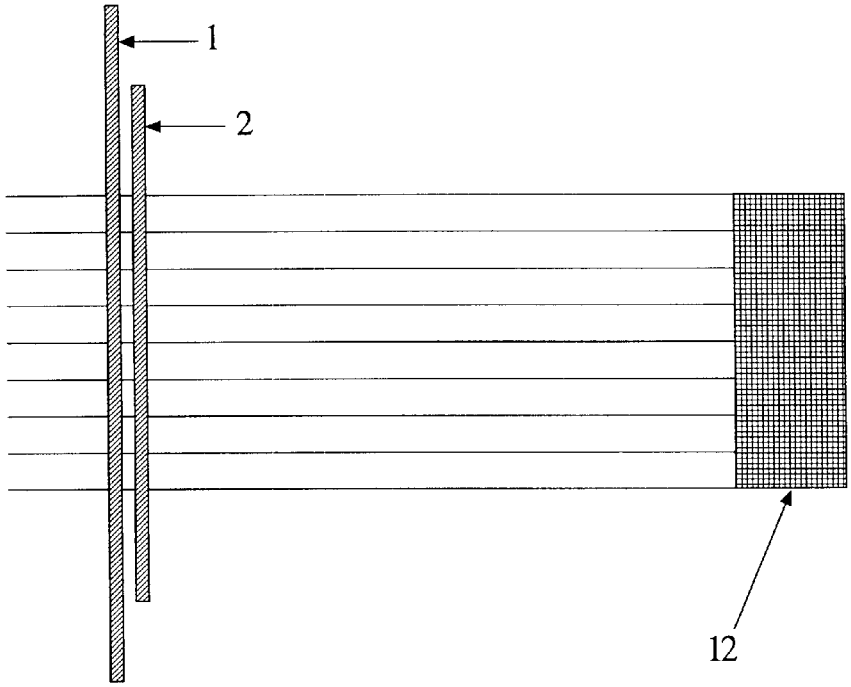
FIG. 3*a* shows the side view of the levelled heald frames and the multilayer warp arrangement.
Figure 3B:
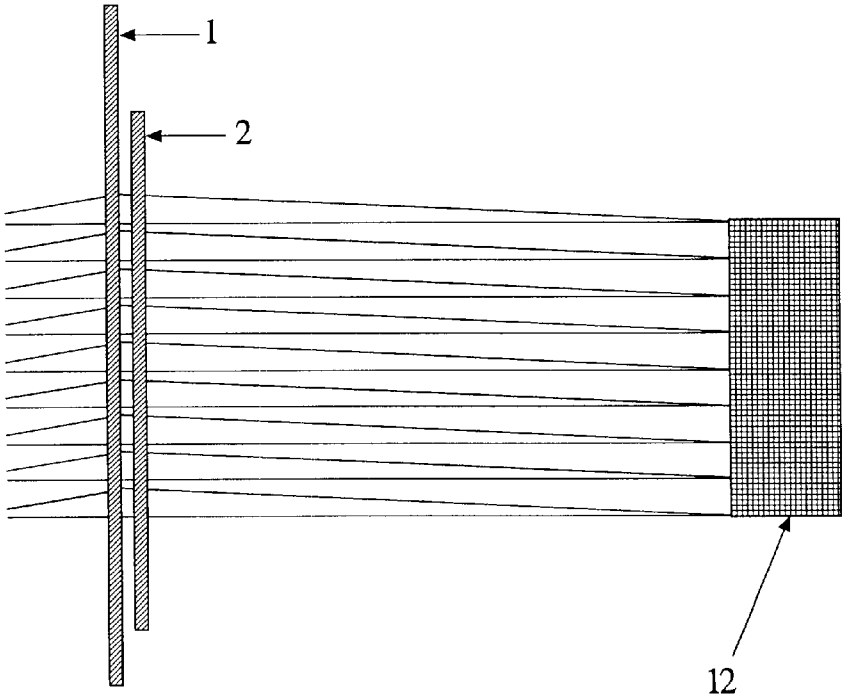
FIG. 3*b* shows by way of an example the side view of the movement of the vertical heald frame in the upward direction to form multiple row-wise sheds.

The above described arrangement defines the level position of the multilayer warp and the shedding system and is shown in FIG. 3*a*. From this level position, the active warp ends (6*a*) passing through the eyes (4*ne*) and (4*se*) of the vertical (1) and the horizontal (2) healds can be respectively displaced in the fibric-thickness and -width directions by moving the required heald frames in the necessary direction. In relation to the passive warp ends (6*p*), which do not pass through the eyes (4*ne*) and (4*se*) of the heald wires, but through the created open spaces (5) and are hence stationary, the displaceable active warp ends (6*a*) can readily form columnwise and row-wise sheds upon their displacement in the required direction from the level position. In FIG. 3*b* is exemplified row-wise shed formation. Multiple columnwise sheds among the active (6*a*) and passive (6*p*) warp yarns would be formed similarly by moving the horizontal heald (2) in a direction perpendicular to the plane of the paper on which the figure is indicated.

It is to be noted that in addition to the sheds that can be formed among the active (6*a*) and the passive (6*p*) warp ends mentioned in the foregoing, columnwise and row-wise sheds are also formed among the active warp ends (6*a*) which are drawn through the superimposed eyes (4*se*) and the other active warp ends (6*a*) which are drawn through the heald eyes (4*ne*) of the heald assemblies (1) and (2), in alternate columns (B, D etc.) and rows (b, d etc.), as a result of their relative displacements. As can be observed in FIGS. 4 and 5, columnwise and row-wise sheds respectively are formed among the active warp ends (6*a*) which are drawn through the superimposed eyes (4*se*), and the other active warp ends (6*a*) which are drawn through the 'normal' (non-superimposed) eyes (4*ne*) of the heald wire (3) as a result of their relative displacements. This relative displacement of the active warp ends (6*a*) is enabled through the particular form of the eye (4*ne*) on the heald wires (3), the particular arrangement of the heald eyes (4*se*) of the two healds (1) and (2), and due to the relative movement of the two healds (1) and (2). As can be observed in FIGS. 2, 4 and 5, the eyes (4*ne*) occupy a vertical position in the horizontal heald wire (3) and a horizontal position in the vertical heald wire (3). At the level position of the system, the drawn warp end (6*a*) is located in the centre of the overlapping eyes (4*se*) as shown in the inset of FIG. 2. The formation of the sheds among the active warp ends is explained below.

For example, in a given column of warp yarns, some active warp yarns (6*a*) pass through the 'normal' eyes (4*ne*) and the remainder active warp yarns (6*a*) of that column pass through the superimposed eyes (4*se*). When the horizontal heald (2) is moved to a given side from its level position, its eye (4*ne*), which occurs in the vertical position, moves the contained warp end (6*a*) in the same horizontal direction; the eye (4*ne*) of the vertical heald (1), which occurs in the horizontal position, providing free space for the warp yarn as shown in shown in FIG. 4. As a result, the active warp yarns (6*a*) of a given column passing through the eyes (4*ne*), which are not displaced, form a shed with the displaced active warp yarns (6*a*) passing through the eyes (4*se*). Similarly, in a given row of warp yarns, some active warp yarns (6*a*) pass through the 'normal' eyes (4*ne*) and the remainder active warp yarns (6*a*) of that row pass through the superimposed eyes (4*se*). When the vertical heald (1) is moved either upwards or downwards from its level position, its eye (4*ne*), which occurs in the horizontal position, moves the contained warp end (6*a*) in the same vertical direction; the eye (4*ne*) of the horizontal heald (2), which occurs in the vertical position, providing free space for the warp yarn as shown in FIG. 5. As a result, the active warp yarns (6*a*) of a given row passing through the eyes (4*ne*), which are not displaced form either an upper or a lower shed with the displaced active warp yarns (6*a*) passing through the eyes (4*se*).

Figure 4:
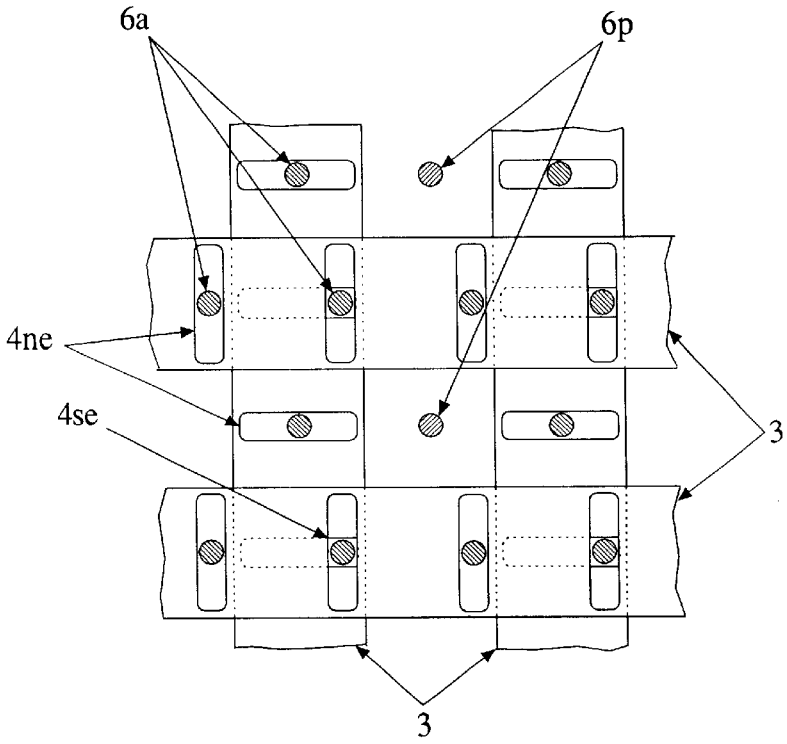
FIG. 4 exemplifies the axial view of the rightward movement of the horizontal heald and the warp end drawn through its eyes, in reference to the level position, to form the columnwise sheds.
Figure 5:
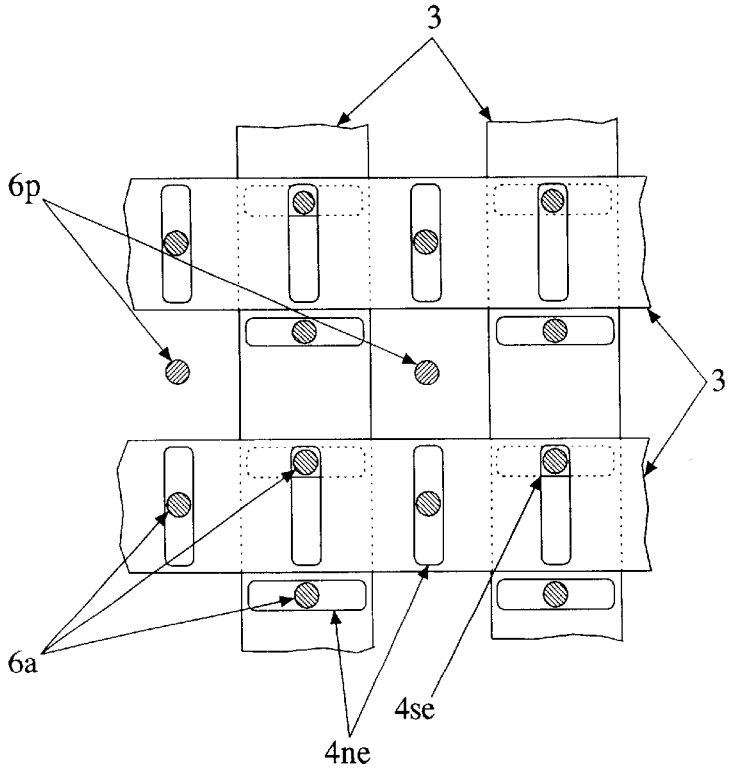
FIG. 5 exemplifies the axial view of the upward movement of the vertical heald and the warp end drawn through its eyes, in reference to the level position, to form the upper row-wise sheds.

In FIG. 4 is exemplified the rightward movement of the horizontal heald wires (3) from its level position. As a result, the active warp yarns (6*a*) passing through the eyes (4*se*) get accordingly displaced in reference to the stationary passive warp yarns (6*p*) and the stationary vertical heald wires (3). As some of the active warp yarns (6*a*) passing through the eyes (4*ne*) of the stationary vertical healds (3) do not get displaced, all the right side columnwise sheds among the active (6*a*)—passive (6*p*) and among the active (6*a*)—active (6*a*) warp yarns of the of the disposed warp yarns (6) get formed. Similarly the left side columnwise sheds can be formed by moving the horoizontal heald wires (3) towards left from its level position. In FIG. 5 is exemplified the upward movement of the vertical heald wires (3) from its level position. As a result, the active warp yarns (6*a*) passing through the eyes (4*se*) get accordingly displaced in reference to the stationary passive warp yarns (6*p*) and the stationary horizontal heald wires (3). As some of the active warp yarns (6*a*) passing through the eyes (4*ne*) of the stationary horizontal healds (3) do not get displaced, all the upper row-wise sheds among the active (6*a*)—passive (6*p*) and among the active (6*a*)—active (6*a*) warp yarns of the disposed warp yarns get formed. Similarly the lower row-wise sheds can be formed by moving the vertical heald wires (3) downwards from its level position.

Figure 6:
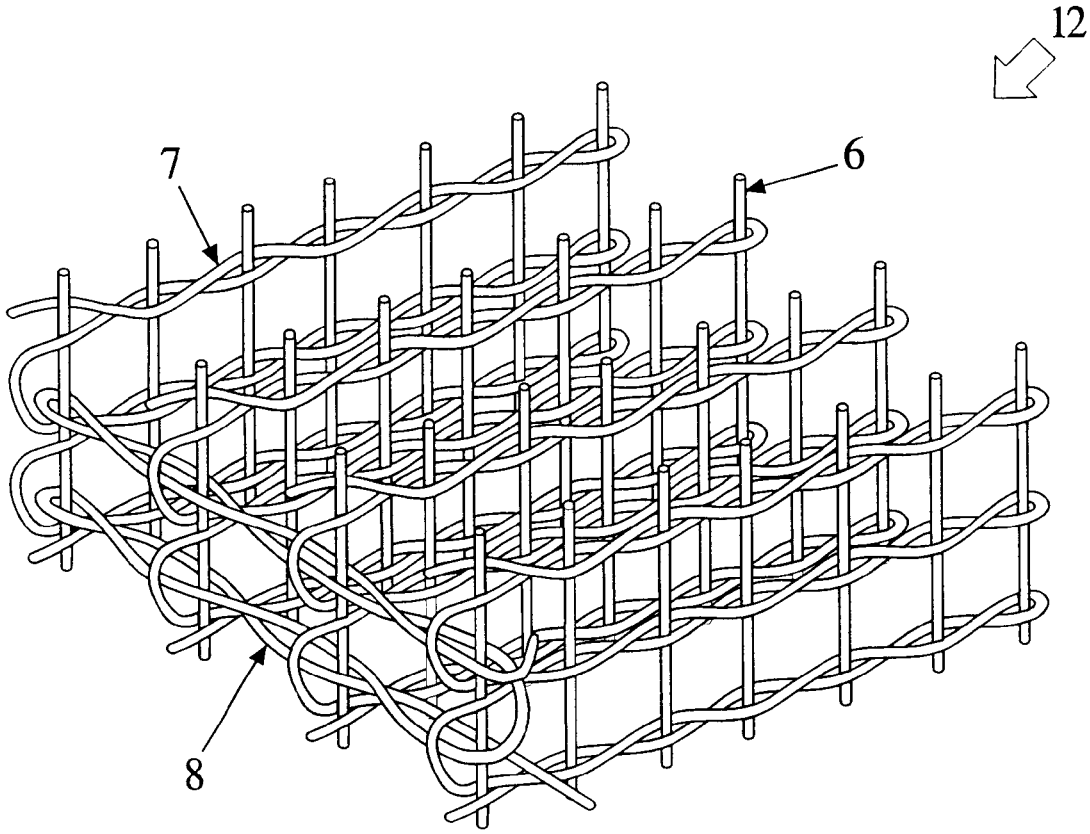
FIG. 6 shows a typical plain weave construction of the woven 3D fabric in which the three orthogonal sets of yarn occur in an interlaced configuration.

By picking a weft in each of the formed columnwise and row-wise sheds, interlacement with the active-active (6*a*–6*a*) and the active-passive (6*a*–6*p*) warp ends of each of the columns and the rows is individually realised. As indicated in FIG. 6, the two sets of weft (7) and (8) interlaces with each of the columns and the rows of the warp yarns (6).

Figure 7A:
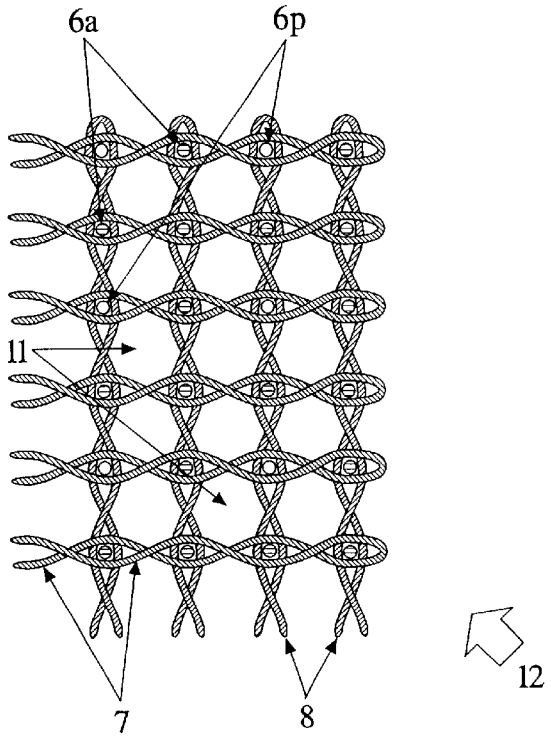
FIG. 7*a* shows the axial view of the fabric variant having the wefts of a given set picked successively.
Figure 7B:
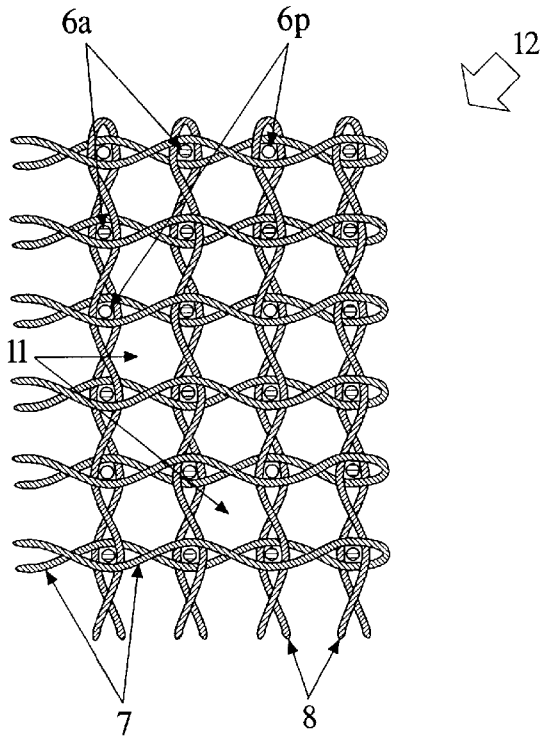
FIG. 7*b* shows the axial view of the fabric variant having the wefts of the two sets picked alternately.

Subsequent to the insertion of a given set of weft, for example (7) in columnwise direction, in the form of either single yarns or hairpin-like folded yarns by employing means like shuttles, rapiers etc., appropriate positioning of the laid-in wefts at the fabric-fell can be effected. The corresponding direction's sheds are closed to revert the warp system to its level position and the produced fabric taken-up. Similarly, the subsequent new sheds of the same direction (i.e. columnwise) can be formed to insert the wefts (7) in the return direction. The row-wise shedding and corresponding weft (8) insertion may be subsequently carried out as just described. As can be inferred, these described sequence of operations for the two directions constitute a cycle of the obtaining weaving process. A plain weave woven 3D fabric corresponding to the said sequence of operations is obtained and indicated in FIG. 6. As can be observed, the woven 3D fabric comprises the interlaced multilayer warp (6) and the two orthogonal sets of weft (7) and (8). For clarity in representation, only the frontmost weft (8) is indicated in FIG. 6. In FIG. 7 are indicated the axial views of the two variants of the fabric producible. FIG. 7(*a*) shows the successive picking of the wefts (7) and (8) in the 'to and fro' directions, and FIG. 7(*b*) shows the alternate picking of the wefts (7) and (8) in the 'to and fro' directions. As can be inferred, both these woven constructions have a network-like structure and these can be produced by simply altering the order of shedding.

It may be noted that the eyes (4*ne*) which will not be involved in superimposed arrangement can also be had in a form other than defined by a major and a minor axes, such as a circle. Further, if necessary, an additional set of heald may be employed the constituting heald wires of which may have the perforations or the eyes in the forms of either circle or defined by a major and a minor axes such that the major axis of the perforation is orientated parallel to the length direction of the heald wire. The purpose of such a set of heald wires will be to assist in the described shedding method to form clear sheds to obviate interference with the weft inserting means.

From the foregoing description of the dual-directional shedding method, the following points will be clear to those skilled in the art:

a) A network-like integration is achieved throughout the fabric cross-section.

b) All the columnwise (or the row-wise) sheds can be formed simultaneously for increased production efficiency and not successively one columnwise (or row-wise) warp layer after the other.

c) Multiple wefts of a set may be picked employing means like shuttles, rapiers etc. and the wefts may be inserted as either a single yarn or a hairpin-like folded yarn.

d) The size of the axial hollow pockets (11) produced in the structure, as shown in FIG. 7, can be controlled to be either large or small by disposing the multilayer warp (6) in a suitable form such as the parallel and the convergent.

e) If required, inclusion of non-interlacing 'stuffer' warp yarns in the hollow pockets in the fabric-length direction can be incorporated. It is also possible to include non-interlacing yarns in the fabric-width and -thickness directions besides in the two diagonal directions across the fabric cross-section.

f) Tubular fabrics of either square or rectangle cross-section and solid profiles like L, T, C, + etc. can also be directly produced by disposing the multilayer warp in accordance with the cross-sectional profile to be produced, and effecting shedding and picking in a suitable discrete manner, for example by employing more than one set of picking means in each of the two directions.

g) Different weave patterns like various twills, satins etc. can be produced by reciprocating suitably threaded heald wires independently and selectively.

h) It is possible to effect shed formation involving only the active warp yarns through reciprocating suitably threaded heard wires independently and selectively.

i) The displacement of a given heald wire is governed by the length of the special eye occurring on the other associated heald wire and also the gap between given two adjacent heald wires.

Having described the basic working principle of producing interlaced 3D fabric comprising two orthogonal sets of weft (7) and (8) and a multilayer warp (6), an example of a useful fabric construction (12*u*) will be described after drawing attention to certain aspects of the above obtained fabric structure.

Figure 8:
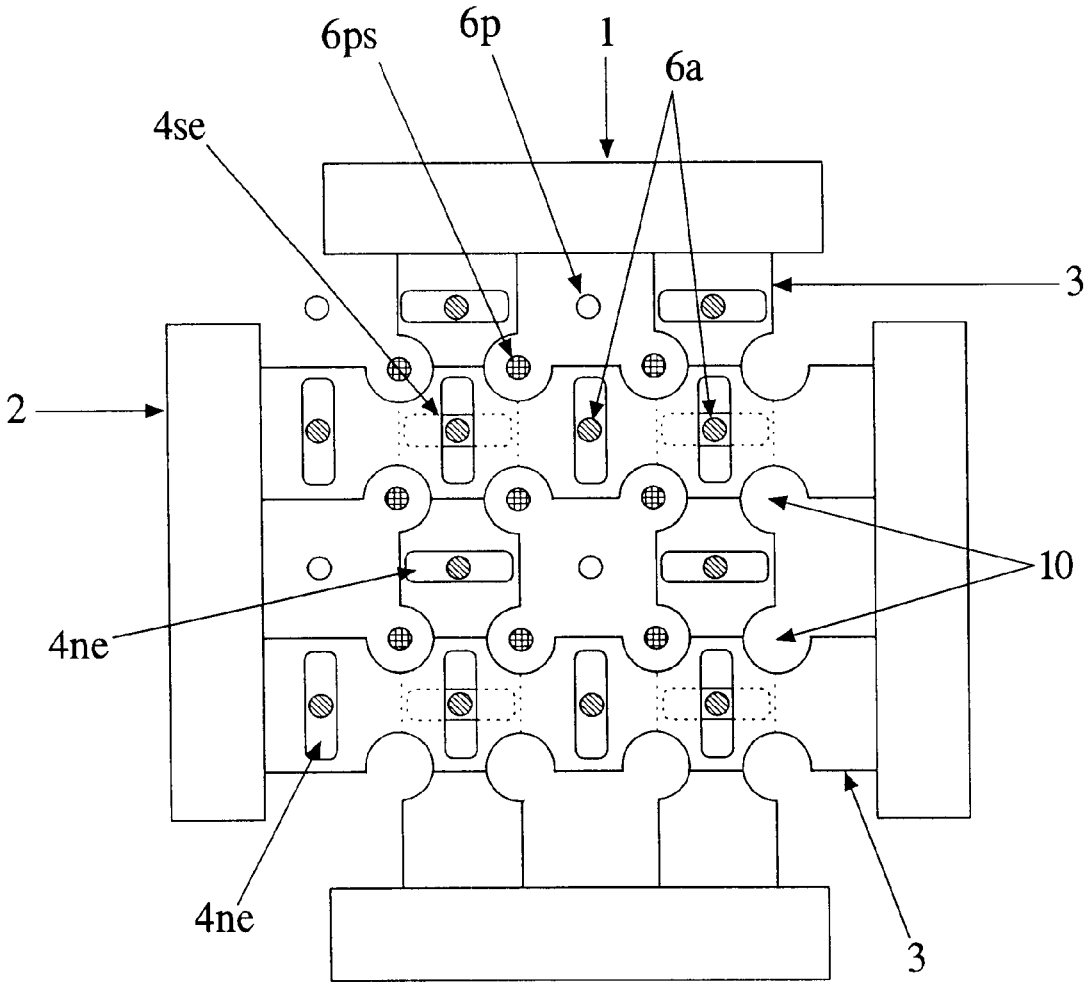
FIG. 8 shows a modified type of heald wires and the arrangement of the two heald assemblies.

The fabric produced according to the above described method may lack in structural stability when large pockets (11) are created and hence such a fabric may find use in composites application only if the yarns can be held through a chemical formulation, thermal welding etc., which can keep the structure together. Without the aid of a suitable chemical formulation, thermal welding etc. the fabric structure will easily collapse when removing from the weaving device and hence the usefulness of such a fabric becomes limited to certain technical applications. Therefore to obtain a fabric which can be stable and hence useful in applications like composite materials, filters etc., the above described shedding method and means can be employed with a minor modification as indicated in FIG. 8. As can be inferred from FIG. 8, the only modification required is to provide necessary clearance (10) at the 'corners' of the superimposed heald wires (3) of the two sets to accommodate additional axial warp ends (6*ps*) between the rows and columns of the axial warp ends (6) described above. Because of such clearances (10), the dual-directional shedding means can be operated as described before without involving these additional axial warp ends (6*ps*) in the shedding operation so that these can be incorporated in the fabric-length direction without interlacing with the wefts (7) and (8). With such an incorporation of the additional 'stuffer' warp ends, the pockets (11) mentioned earlier tend to become filled with these yarns and thus the fabric acquires stability against collapse upon removal from the weaving device. Further, the inclusion of the non-interlacing, and hence crimpless, 'stuffer' warp yarns accords mechanical strength to the fabric. This way the objective of producing a 3D fabric block from which can be cut obtained suitable preforms or filter materials etc. of any desired shape without the risk of its splitting up and the fabric structure collapsing is also achieved. The relevant different steps of constructing the fabric block of this invention which additionally incorporates non-interlacing, multi-directionally orientated yarns is described below in reference to FIG. 9. The movements of the healds described below are viewed from the rear of the shedding system in the direction of the fabric-fell.

Figure 9A:
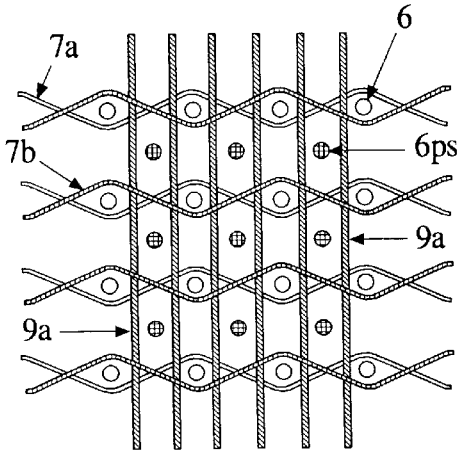
FIGS. 9*a*–9*f* show a step by step formation of a useful fabric variant construction according to this invention which additionally incorporates non-interlaced multi-directionally orientated yarns.
Figure 9B:
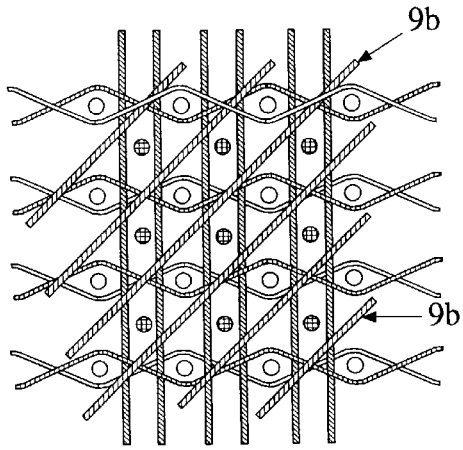
Figure 9C:
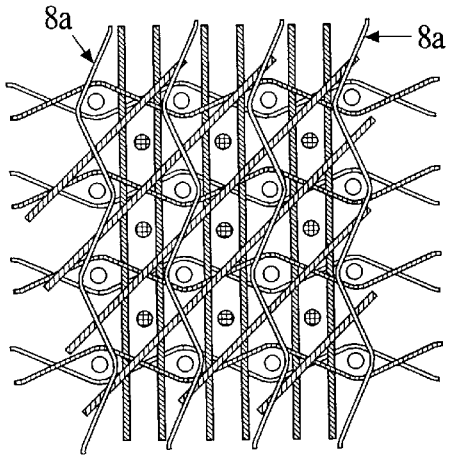
Figure 9D:
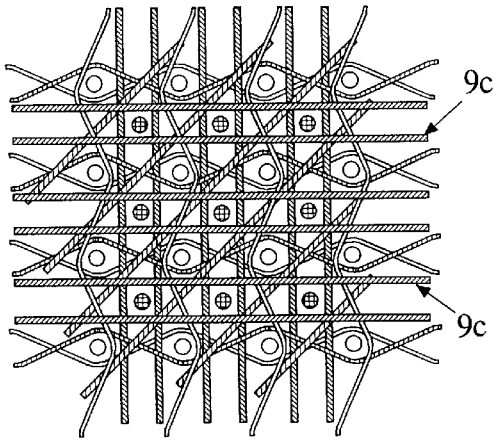
Figure 9E:
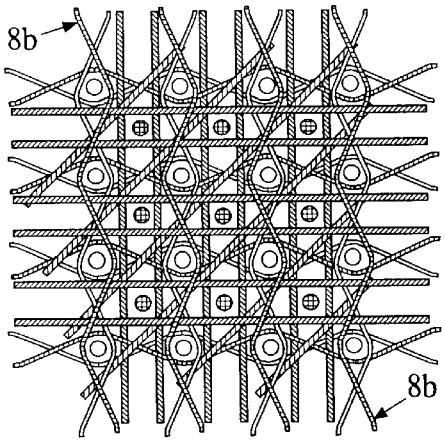
Figure 9F:
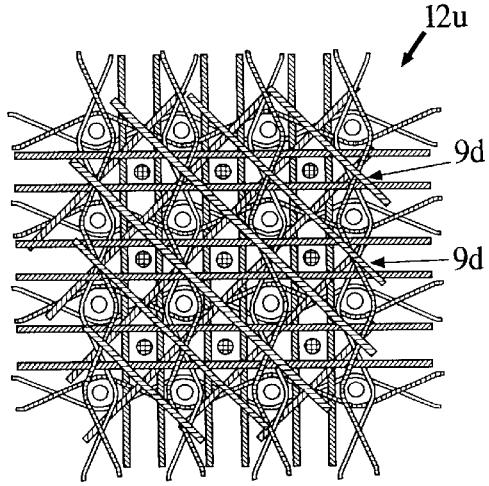

The formation of sheds in the row-wise and the columnwise directions of the multilayer warp can be effected by reciprocating the healds just as described earlier. To start with, the multilayer axial warp yarns (6) are subjected to the shedding operation to form the upper row-wise sheds. Referring to FIG. 9*a,* into each of these upper row-wise sheds a corresponding horizontal weft (7*a*) is inserted which interlaces with the corresponding row-wise axial warp yarns (6). The sheds are then closed. A set of non-interlacing vertical yarns (9*a*) is next incorporated between each of the two adjacent columns of the multilayer warp (6) without any interlacement. The rows of multilayer warp yarns (6) are subjected to the next cycle of shedding operation to form the lower row-wise sheds and the set of horizontal wefts (7*b*) inserted. The construction of the produced fabric at this stage would appear as shown in FIG. 9*a* in which the set of non-interlacing vertical yarns (9*a*) will be held between the two inserted wefts (7*a* and 7*b*) and orientated in the fabric-thickness direction. Next, the set of non-interlacing diagonal yarns (9*b*) is incorporated in the diagonal direction as indicated in FIG. 9*b* without any interlacement with the multilayer warp comprising yarns (6) and (6*ps*). This step is followed by the formation of the right side columnwise sheds in the multilayer warp (6) into each of which a corresponding weft of the vertical set (8*a*) is inserted and which interlaces with the axial yarns (6) as indicated in FIG. 9*c*. The sheds are then closed. The set of diagonal yarns (9*b*) become held between the two inserted wefts (7*b* and 8*a*). A set of non-interlacing horizontal yarns (9*c*) is next incorporated between each of the two adjacent rows of the multilayer warp comprising yarns (6) and (6*ps*) without any interlacement as indicated in FIG. 9*d*. The set of the multilayer warp yarns (6) is subjected to the next cycle of left side columnwise shedding operation and the weft of the vertical set (8*b*) inserted. The set of non-interlacing horizontal yarns (9*c*) will be held between the vertical wefts (8*a* and 8*b*). The construction of the produced fabric at this stage would appear as shown in FIG. 9*e*. Next, the set of non-interlacing diagonal yarns (9*d*) is incorporated in the diagonal direction as indicated in FIG. 9*f* without any interlacement with the warp comprising yarns (6) and (6*ps*). The set of the non-interlacing diagonal yarns (9*d*) will be held between the interlacing wefts of vertical set (8*b*) and the following interlacing wefts of the horizontal set (7*a*) of the next cycle. This described sequence of operations is repeated cyclically together with the necessary complementing operations required in the weaving process such as positioning the laid-in yarns at the fabric-fell, advancing the produced fabric in accordance with the desired take-up rate, letting-off the warp yarns etc. etc. at the proper moments of a given cycle of the weaving process to produce the useful fabric construction (12*u*) shown in FIG. 9*f*.

As can be inferred from FIG. 6, the interlacement of the two orthogonal sets of weft with the multilayer warp occurs throughout the fabric cross-section and produces a network-like structure. The fabric thus acquires a very high degree of integrity. The fabric construction shown in FIG. 9*f* possesses the same type of interlacing with an improved feature by way of additionally incorporating non-interlacing and directionally orientated yarns in the vertical, horizontal and the two diagonal directions besides the fabric-length direction. Because the fabric construction shown in FIG. 9*f* has a very high degree of network-like integrity throughout the cross-section due to the interlacing provided by the two orthogonal sets of weft (7 and 8) and the multilayer warp (6), it will not split up if cut just as a sheet of conventional woven 2D fabric does not become unbound when cut. Also, with the incorporation of non-interlaced multi-directionally orientated yarns, the mechanical performance of the fabric becomes improved because these yarns have no crimp and the obtained fabric also has a relatively higher fibre volume-fraction. Therefore, such a fabric construction becomes useful in applications such as the manufacture of composite materials, filters etc. because from a produced block of such a woven fabric, suitable fabric item of any desired shape can be cut obtained without the risk of its splitting up.

Further, this method is not limited to the production of a block of fabric (12) or (12*u*) having either a square or a rectangle cross-section. By disposing the multilayer warp in accordance with the desired shape of cross-section, including tubular types with square or rectangle cross-section, and following suitable discrete sequence of operations described above, a network-like 3D fabric construction (12) or (12*u*) of the corresponding cross-sectional profiles can also be produced. It may be mentioned here that depending on the complexity of the cross-section profile being produced, more than one set of weft inserting means for each of the two directions (i.e. row-wise or columnwise directions) can be employed. Such different sets of the weft inserting means of a given direction may be operated either simultaneously or discretely to achieve the required weft insertion for the profile under production. This method of fabric production is therefore not limited to the production of a particular cross-sectional profile. Further, because of the network-like interlacement, there is no need to carry out any separate binding operation at the exterior surfaces of the fabric to achieve the fabric integrity. This elimination of the binding process is apparently advantageous in simplifying and quickening the fabric production. Further, this method of producing network-like interlaced 3D fabric blocks and other cross-sectional profiles eliminates the need to develop methods for producing certain cross-sectional shapes as from the produced block of the network-like fabric obtainable through this method, any desired shape of preform, filter etc. materials can be easily cut obtained without the risk of splitting up.

Figure 10A:
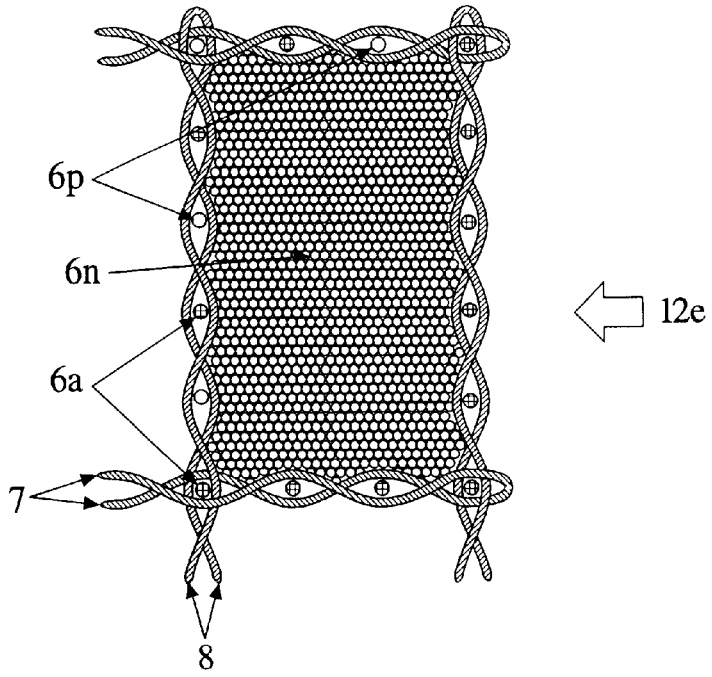
FIG. 10*a* shows the front view of a useful fabric construction in which only the exterior part is interlaced to function as a woven covering for the non-interlaced yarns occurring internally.

Further, it is possible to produce another useful fabric material by carrying out shedding involving only the warp yarns occurring at the exteriors of the disposed multilayer warp (6) by suitably controlling the heald wires (3), the eyes (4*ne*) and/or (4*se*) of which have been correspondingly threaded. In reference to FIG. 10*a,* the top and the bottom woven surfaces can be produced by reciprocating the vertical heald (1) to displace the active warp yarns (6*a*) to form row-wise sheds among the passive warp yarns (6*p*) and the other active warp yarns (6*a*) which are not displaced in the rows, as described earlier, and inserting the wefts (7) into these exterior top and bottom row-wise sheds. Similarly, the left and the right side woven surfaces can be produced by reciprocating the horizontal heald (2) to displace the active warp yarns (6*a*) to form columnwise sheds among the passive warp yarns (6*p*) and the other active warp yarns (6*a*) which are not displaced in the columns, as described earlier, and inserting wefts (8) into these exterior left and right columnwise sheds. Thus such operations will produce an interlaced exterior surface which will function as a woven covering for the internally occurring non-interlacing multilayer yarns (6*n*) of the fabric material (12*e*) as shown in FIG. 10*a.*

Figure 10B:
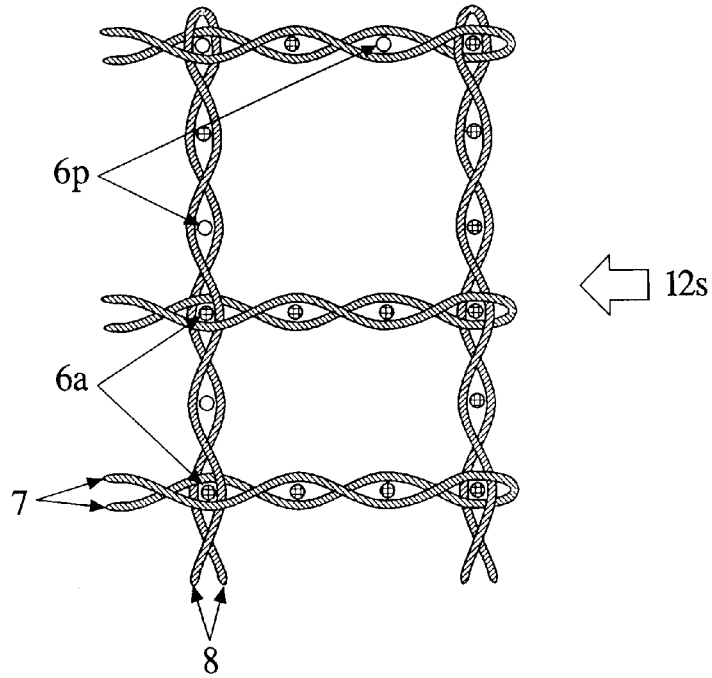
FIG. 10*b* shows the front view of a useful fabric in which the specifically disposed yarns of the multilayer warp are interlaced to obtain a sandwich or a core type of fabric construction.

Further, it is also possible to produce a core or a sandwich type of fabric material (12*s*) shown in FIG. 10*b* by interlacing the suitably disposed multilayer warp yarns. Here again, by suitably controlling the heald wires (3), the eyes (4*ne*) and/or (4*se*) of which have been correspondingly threaded, the row-wise and the columnwise sheds can be formed as described earlier. Inserting wefts (7) and (8) into the formed row-wise and columnwise sheds respectively, the interlaced fabric structure (12*s*), generally referred to as sandwich or core type fabric structure. as shown in FIG. 10*b*, is obtained.

Further, it is also possible to produce multiple woven 2D fabric sheets employing the described shedding means. Such multiple sheets can be produced by disposing the multilayer warp as described earlier and reciprocating either the vertical (1) or the horizontal heald (2) to form correspondingly either the row-wise or the columnwise sheds and inserting correspondingly either wefts (7) or (8) into the formed sheds of the given direction. Thus by forming row-wise sheds and effecting corresponding picking, the multiple sheets of woven 2D fabrics will be produced in the horizontal form. Similarly by formiing columnwise sheds and effecting corresponding picking, the multiple sheets of woven 2D fabrics will be produced in the vertical form in reference to the shedding means arrangement shown in FIG. 2.

Needless to mention, in all the above described methods of fabric production, the other complementing operations of the weaving process like the beating-up, taking-up etc. will be carried out at the appropriate moments of the weaving cycle to produce a satisfactory fabric of the required specification.

It will be apparent to those skilled in the art that it is possible to alter or modify the various details of this invention without departing from the spirit of the invention. Therefore, the foregoing description is for the purpose of illustrating the basic idea of this invention and it does not limit the claims which are listed below.

What is claimed is:

1. A woven 3D fabric material comprising:

a set of multilayer warp yarns incorporated in accordance with a fabric cross-sectional profile and forming vertical and horizontal woven portions, whereby at least one pocket is defined by four adjacently occurring warp yarns individually interlacing with two mutually perpendicular sets of wefts; and at least one of the pockets includes a non-interlacing stuffer warp yarn therein.

2. The woven material according to claim 1, wherein non-interlacing yarns are incorporated in at least one of the directions defined by a thickness or width of the fabric or one of two diagonal directions of an axial cross-section of the fabric.

3. The woven 3D fabric material according to claim 1, wherein the fabric is tubular with either a square or rectangle cross-section.

4. The woven 3D fabric material according to claim 3, wherein the interlaced exterior surface of the tubular fabric covers internally arranged non-interlacing yarns.

5. The woven 3D fabric material according to claim 3, wherein the woven material is of core or sandwich type.

6. The woven 3D fabric material according to claim 1, comprising one or more fibrous materials chosen from carbon fiber, synthetic fiber, natural fibers including fibers from the sea, inorganic fiber, glass fiber and metallic fibers.

7. The woven 3D fabric material according to claim 6, wherein the woven fabric material comprises a combination of fibrous and non-fibrous material.

8. The woven 3D fabric material according to claim 6, wherein at least one of the yarn materials is impregnated with a chemical formulation.

9. A device for producing a woven material with a weaving method incorporating the operation of shedding in two mutually perpendicular directions to form rowwise and columnwise sheds in a multilayer warp disposed according to a cross-sectional profile of the fabric to be produced, said device comprising shedding means, said shedding means including flat heald wires having at least one of the following characteristics:

one or more perforations defined by a major and a minor axis with the major axis of the perforations orientated perpendicular to a length of the flat heald wire and the perforations arranged in a series with regular spacing for drawing warp yarns through the perforations according to the cross-sectional profile of the fabric;

the flat heald wires having an additional perforation defined by a circular cross-section between two given perforations defined by a major and a minor axis for drawing warp yarns through the perforations for assisting in shed formation;

the flat heald wires having cut out clearance portions between two adjacent perforations such that the cut out clearance portions occur at both sides of the flat heald wires to accommodate additional warp yarns such that the accommodated warp yarns are not displaced by the flat heald wires; and the shedding means incorporating flat heald wires having a series of perforations defined by a circular cross-section, or by a major and a minor axis or both and with the major axis of the perforations orientated parallel to a length of the flat heald wire for assisting in forming sheds.

10. The device according to claim 9, wherein the dual-directional shedding means comprise two sets of perforated flat heald wire assemblies in which the flat heald wires in each heald assembly are spaced apart and the two sets of heald assemblies are arranged in one of the following orientations:

parallel planes;

a mutually perpendicular configuration;

a manner to provide openings between the superimposed mutually perpendicularly occurring perforations for drawing warp yarns therethrough; and a manner to provide openings between the mutually perpendicularly occurring spaced apart flat heald wires for drawing the warp yarns therethrough.

11. The device according to claim 9, wherein the dual-directional shedding means in which the perforated flat heald wires of each set are rectilinearly reciprocable in respective planes in one of the following manners:

collectively as a whole;

in select groups;

individually; and in select groups and individually.

12. The device according to claim 9, wherein the dual-directional shedding means in which the perforated flat heald wires of each set are rectlinearly reciprocable in respective planes in one of the following manners:

in the same direction at the same time;

in the opposite directions at the same time; and in a discrete manner.

13. The device according to claim 9, wherein the dual-directional shedding means includes means for producing a material in which the exterior yarns of the multilayer warp are only involved for interlacement and such an outer interlaced assembly serves to function as a woven covering for the elements which occur internally.

14. The device according to claim 9, wherein the dual-directional shedding means includes means for producing a woven material in which suitably disposed yarns of the multilayer warp are interlaced to result in a 'sandwich' or 'core' structure.

15. The device according to claim 9, wherein the dual-directional shedding means includes means for producing multiple woven 2D fabric sheets simultaneously.

* * * * *